US005253481A

United States Patent [19]

Takagi et al.

[11] Patent Number: 5,253,481

[45] Date of Patent: Oct. 19, 1993

[54] CONTROL UNIT FOR ACTIVATING COMPRESSOR

[75] Inventors: Nobukazu Takagi; Osamu Takahashi, both of Higashimatsuyama; Akihito Uetake; Osamu Shinkawa, both of Hino, all of Japan

[73] Assignees: Zexel Corporation; Seiko Epson Corp., both of Tokyo, Japan

[21] Appl. No.: 935,972

[22] Filed: Aug. 27, 1992

[30] Foreign Application Priority Data

Aug. 29, 1991 [JP] Japan ..... 3-218748

[51] Int. Cl.[5] ..... F25B 1/00

[52] U.S. Cl. ..... 62/126; 62/193; 62/228.4

[58] Field of Search ..... 62/129, 126, 228.1, 62/228.4, 83, 127, 192, 193, DIG. 2

[56] References Cited

U.S. PATENT DOCUMENTS 3,411,313 11/1968 Brown et al. ..... 62/192
3,744,267 7/1973 Norbeck ..... 62/193
4,090,371 5/1978 Keane ..... 62/129
5,088,297 2/1992 Maruyama et al. ..... 62/228.4

FOREIGN PATENT DOCUMENTS 62-215481 9/1986 Japan .
62-23589 1/1987 Japan .
1-193090 8/1989 Japan .
2-81982 3/1990 Japan .

*Primary Examiner*—Harry B. Tanner
*Attorney, Agent, or Firm*—Kanesaka & Takeuchi

[57] ABSTRACT

The compressor activation control unit a rotation detecting means for detecting whether or not the motor is normally activated when the compressor is activated, a judging means for judging that the compressor interior is filled with a liquid refrigerant when the motor is not judged to be in the normal activating condition by the rotation detecting means, and a control means for step-driving the motor at a very slow-speed no more then one rotation per second through the driving circuit when the motor interior is judged to have been filled with the liquid refrigerant by the judging means.

8 Claims, 7 Drawing Sheets

CONTROL UNIT FOR ACTIVATING COMPRESSOR

BACKGROUND OF THE INVENTION

This invention relates to a control unit for controlling activation of a compressor whose interior is filled with a liquid refrigerant. When a compressor is stopped for a long time, a gaseous refrigerant is liquefied and may enter together with a lubricating oil the compressor and fills its interior, causing the so-called sleeping condition. When the compressor is activated under this condition, the liquid refrigerant and lubricating oil within the compressor are liquid-compressed, possibly breaking the compressor. To prevent this, there have heretofore been provided, measures such as (1) an accumulator is provided to prevent the liquid from entering the compressor, (2) a driven crank is disposed to discharge liquid from the compressor (for example, Japanese Patent Laid-open Print No. 215481/1986 and (3) a relief valve is disposed to release the liquid from the compressor (for example, Japanese Patent Laid-open Print No. 81982/1990, Japanese Laid-open Print No. 193090/1989, and Japanese Patent Laid-open Print No. 23589/1987).

But, the measure above (1) has such drawbacks that the number of parts increases, the of the compressor increases, and that modification the of accumulator the 5 becomes needed with performance increasing. The above measure (2) has such drawbacks that the number of parts increases, the assembling work is difficult, and operation that the lacks reliability. The measure above (3) has such drawbacks that the number of parts increases, the assembling work is troublesome, and that the reliability is low.

SUMMARY OF THE INVENTION

Therefore, this invention aims to provide control unit for activating a compressor which can minimize the increase of the number of parts and the difficulty of assembling work, and can easily activate a compressor which is filled with a liquid refrigerant.

The compressor activation control unit of this invention, in a compressor provided with a compressing part for compressing a refrigerant, a motor for rotatably driving the compressing part, and a drive circuit for driving the motor, is structured by providing a rotation detecting means for detecting, whether or not the motor is normally activated when the compressor is activated, a judging means for judging that the compressor interior is filled with a liquid refrigerant when the motor is not judged to be in normal activating condition by the rotation detecting means, and a control means for step-driving the motor at speed rotation of no more than one rotation per second through the driving circuit when the motor interior is judged to have been filled with a liquid refrigerant by the judging means. And, the step drive of the motor preferably has the step number 360 degrees that is determined by dividing by integral multiples of the number of phases of the applicable motor.

DESCRIPTION OF THE PREFERRED EMBODIMENTS

When the compressor is activated, the motor is first activated by the drive circuit, and it is detected by the rotation detecting means whether or not the motor is normally activated. When it is judged by the output of the rotation detecting means that the motor is not normally activated, the judging means judges that the compressor is filled with the liquid refrigerant and the motor is step-driven by the control means via the drive circuit.

In this case, the step driving is effected, as follows. The rotor of the motor is rotated at very low speed such as one rotation or less per second to 1 to 2 rotations in several seconds so as to rotate step wise each magnetic pole formed on the stator side. Therefore, by the slow move of the rotor, the compressor is operated as a pump and the liquid refrigerant within the compressor is discharged little by little. When the liquid refrigerant is almost completely discharged, the compressor is normally operated.

When the motor is of the three phase, the step number of step driving in one rotation is a integral multiple of 3, that is, one of 3, 6, 12, . . ., and when the motor is of the four phase, it is one of 4, 8, 16,. . ..

Figure 1:
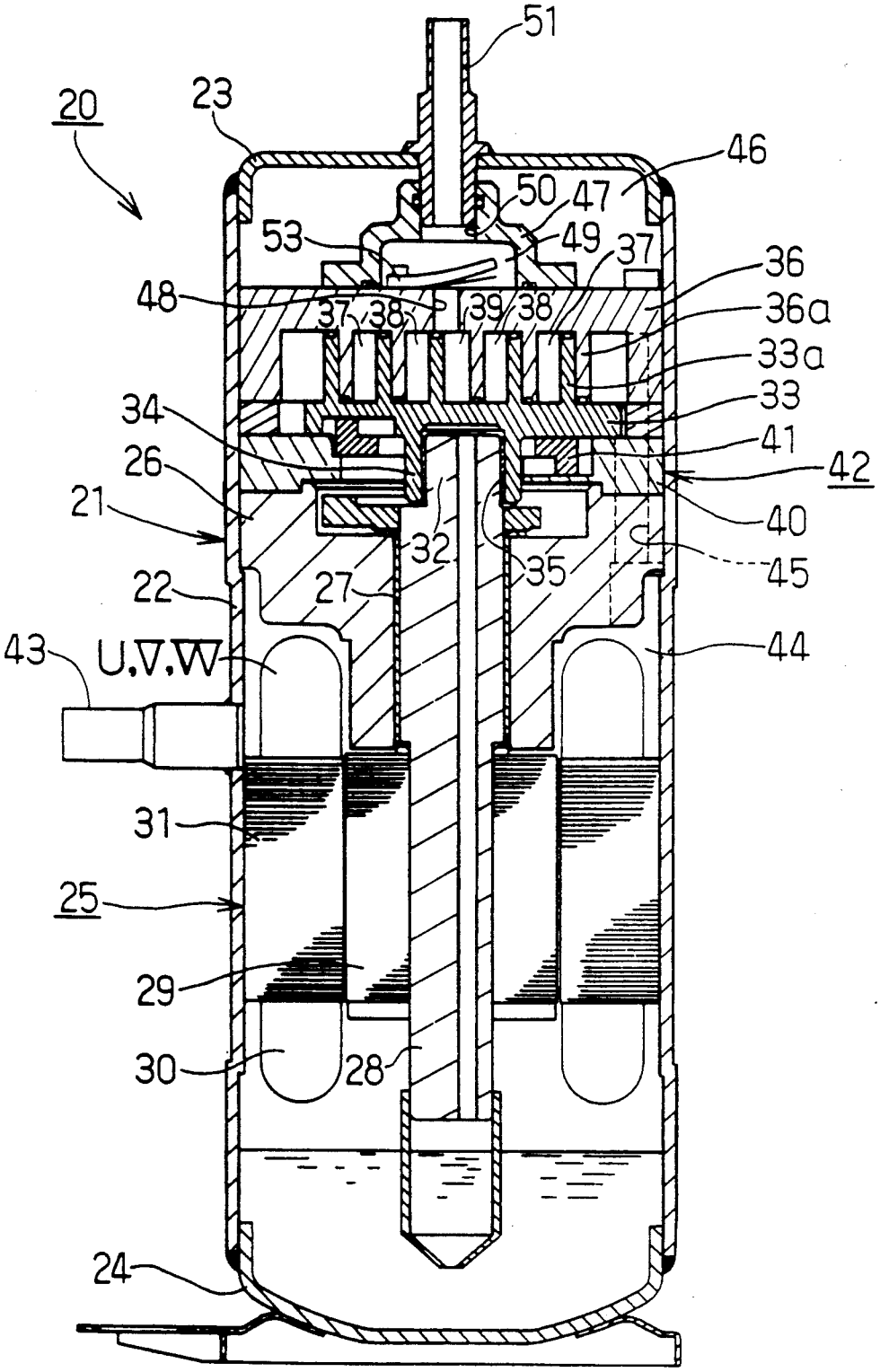
FIG. 1 is a longitudinal section of a compressor according to one embodiment of this invention.

One embodiment of this invention will be described below with reference to drawings. In this embodiment, the compressor is of the scroll type. FIG. 1 shows compressor 20 of this embodiment. Case 21 consists of cylinder part 22 and upper and lower closed parts 23, 24. At the lower part inside the case is disposed DC brushless motor 25. This motor 25 consists of drive shaft 28 whose upper part is supported by support block 26 via bearing 27, rotor 29 fixed to the drive shaft 28, stator 30 fixed to the case 21, and exciting coil 31 disposed on the stator 30.

Figure 2:
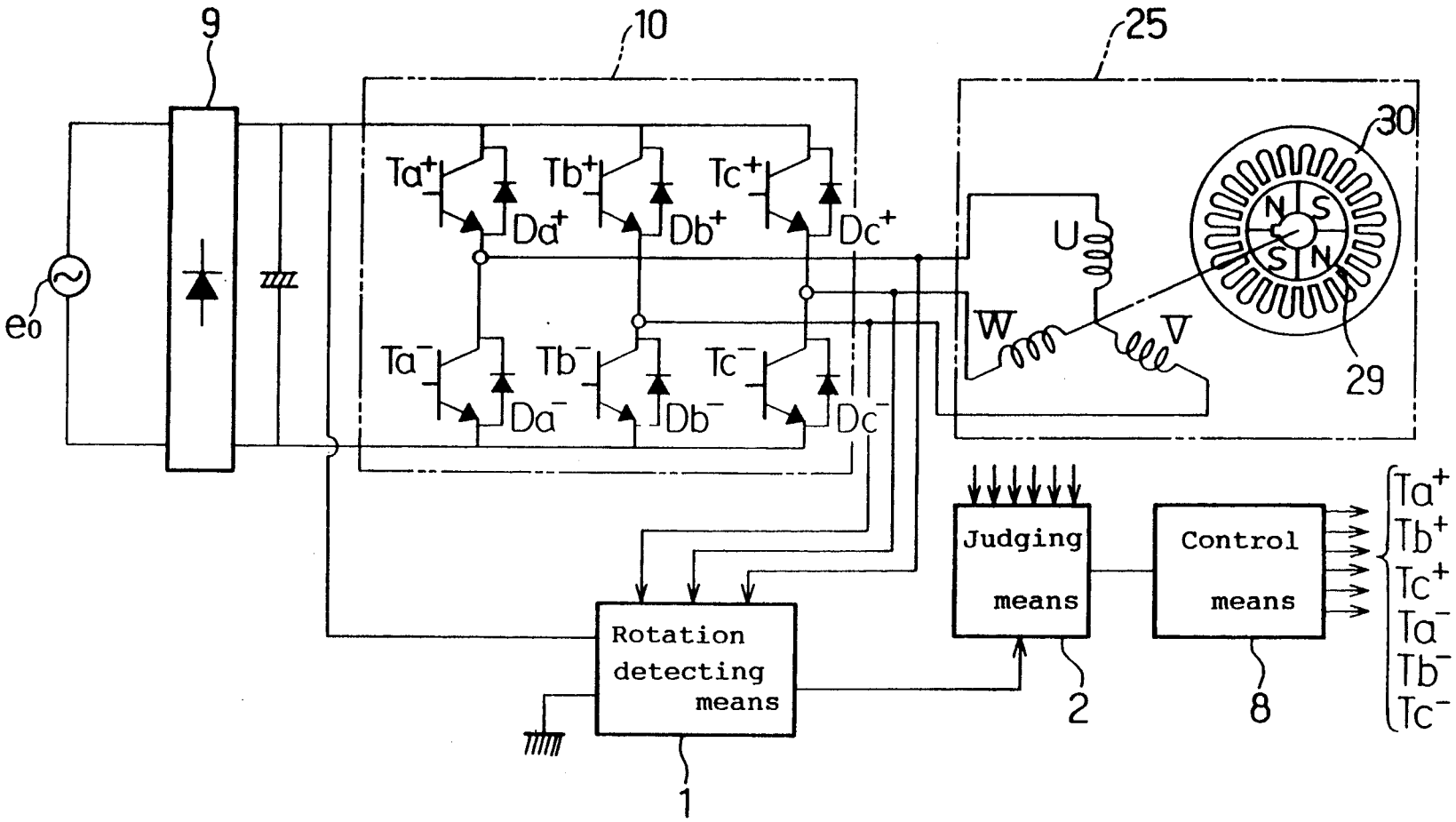
FIG. 2 is a circuit diagram showing a drive circuit.

The 25 is a position sensorless, brushless DC motor which does not have a position sensor for detecting the position of the rotor 29, and as shown in FIG. 2, the rotor 29 is quadruple and exciting coil 31 has U, V and W phases connected by star connection.

At the top end of the above drive shaft 28 is formed crankshaft 32 which is off-centered from the shaft center of the drive shaft 28 by a certain distance, and this crankshaft 32 is inserted in connecting insert part 34 of rocking scroll member 33 via bearing 35. Scroll 33*a* of the rocking scroll member 33 is engaged with scroll 36*a* of stationary scroll member 36 which is fixed to the case 21. These scrolls 33*a*, 36*a* form intake pressure chamber 37, intermediate pressure chamber 38 and discharge pressure chamber 39 and, a gas is compressed in order. On the back side of the rocking scroll member 33 is disposed rotation preventing mechanism 42 consisting of thrust plate 40, Oldam's ring 41, etc.

On the side part of the above case 21 is attached intake pipe 43. This pipe 43 is communicated with the intake pressure chamber 37 through intake port 45 disposed on the support block 26 and the thrust plate 40, forming a low-pressure shell. Low-pressure upper space (intake side) 46 is formed over the stationary scroll member 36 within the above case 21. Within this space 46 is disposed dividing member 47 fixed to the stationary scroll member 36. This dividing member 47 has therein high pressure chamber 49 communicating with discharge port 48 disposed in the stationary scroll member 36. At the top of this dividing member 47, connection hole 50 is provided, and to this connection hole 50 is connected discharge pipe 51 which extends outside the case 21. The above high pressure chamber 49 is formed cylindrically in cross section. This high pressure chamber 49 has lead valve (opening and closing valve) 53 therein. And, compression part is structured by the rocking scroll member 33 and the stationary scroll member 36.

Figure 5:
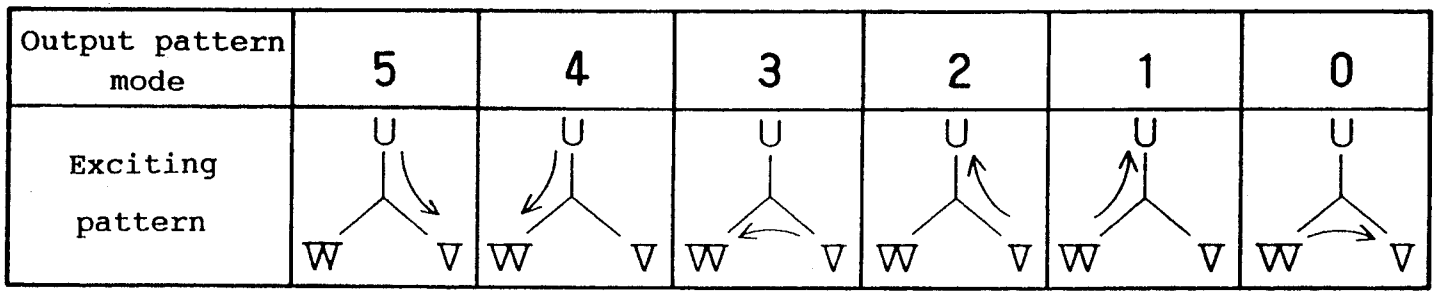
FIG. 5 is a drawing showing an excitation pattern.

Further, the drive circuit 10 is connected to the exciting coils U, V and W of each layer disposed on the stator of the above motor 25. This drive circuit 10 is formed as a 120° conduction voltage type invertor circuit and made up of P or positive side transistors Ta+, Tb+ and Tc+ connected with P side reflux diodes Da+, Db+ and Dc+ and N or negative side transistors Ta−, Tb− and Tc− connected with N side reflux diodes Da−, Db− and Dc−. And, the P side transistor and the N side transistor are combined and chopper controlled, so that three-phase DC current is passed in order to the selected two windings of the respective phases. And, magnetic field is formed on the stator 30 and the rotor is rotated. For example, as the exciting pattern to continue normal operation, setting is made as shown in FIG. 5. By commutating in order in these exciting pattern modes 5-0, a motor 25 can be driven. As the driving control method of the motor 25, the drive method of a position sensorless, brushless DC motor is described "A structuring method of position sensorless, brushless DC motor" by Suzuki, Ogasawara and Akagi, Denki Gakkai Sangyo Oyobumon Zenkoku Taikai No 34, 1988). This control method is used in this embodiment. In FIG. 2, represents an AC power source and 9 a rectification circuit.

Figure 3:
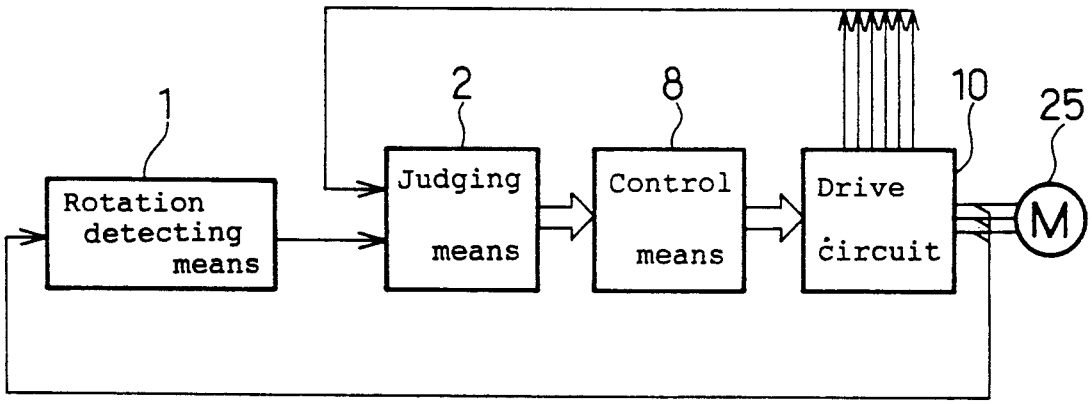
FIG. 3 is a block diagram of a control device for activating a motor.

To the above drive circuit 10, as shown in FIG. 2 and FIG. 3, the rotation- detecting means 1 to effect activation control and the control means 8 are connected in order. The above rotation detecting means 1 indirectly detects a counter electromotive force which is generated in each exciting coil U, V and W by the rotation of the rotor 29, to determine if the motor 25 is rotating. That is to say, when the rotor 29 rotates, a counter electromotive force is generated in the exciting coil, and by the generation of counter electromotive force, the reflux diode of open phase (phase of the exciting coil through which current is not flowing) becomes conducting. More specifically, the terminal voltage of open phase varies by the counter electromotive force, and respectively anode electric potential of reflux diode on respectively P side becomes higher than the standard voltage, or the cathode electric potential of reflux diode on the N side becomes lower than the standard voltage, and the reflux diode becomes conducting. By detecting the diode in this conducting state, a rotation, signal indicating the rotating state of the motor is generated.

Figure 4:
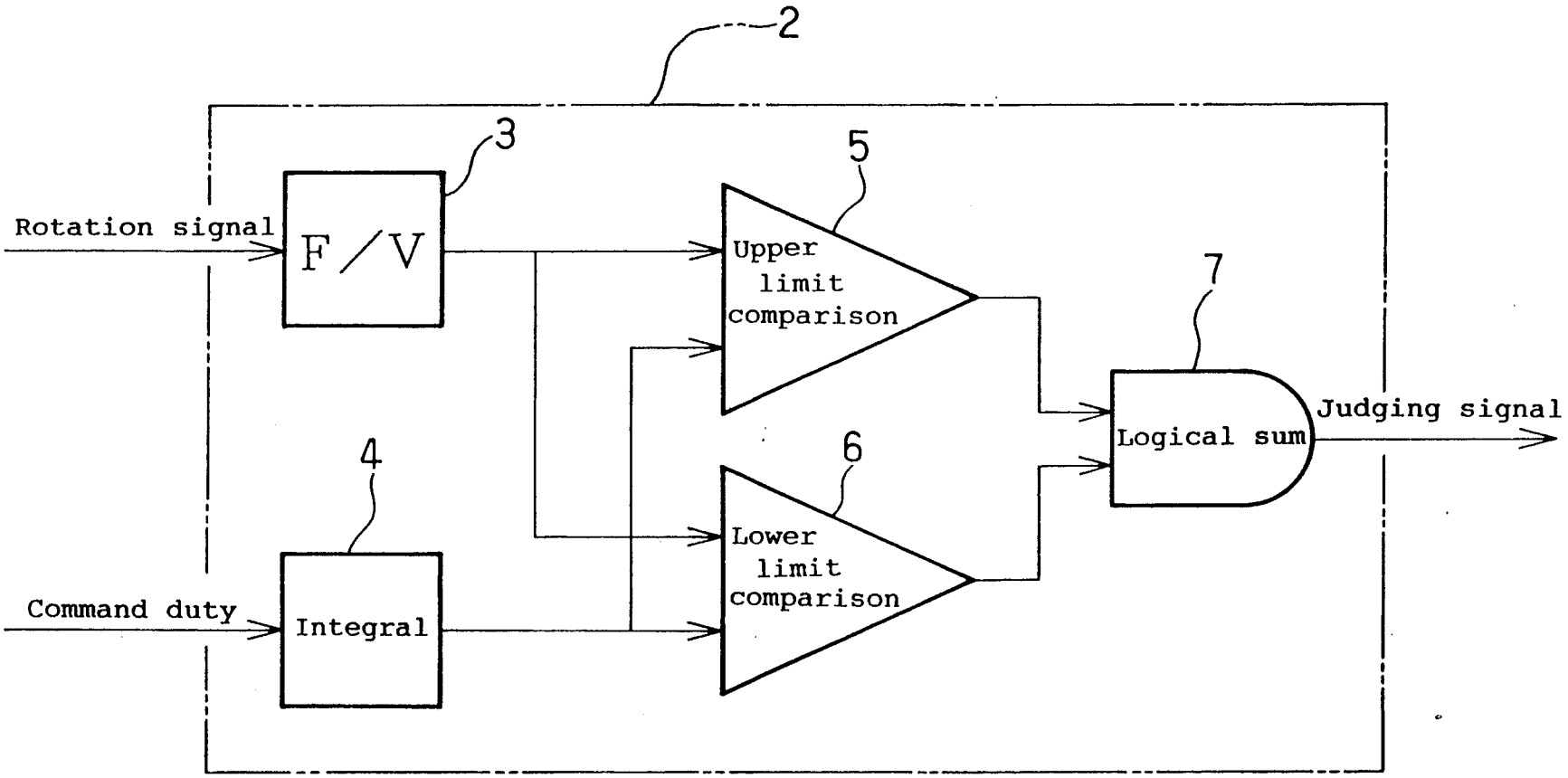
FIG. 4 is a block diagram of a judging means.

The above judging means 2 consists of, for example as shown in FIG. 4, F/V converter 3 for making F/V conversion of the rotation signal from the rotation detecting means 1, integrating circuit 4 for integrating a command duty signal (drive signal) applied to a pair of transistors of the drive circuit 10 by the control circuit 8 to be described afterward, comparators 5, 6 for comparing whether the outputs 35 of the F/V converter 3 and the integrating circuit 4 are higher or lower than the predetermined upper limit or lower limit and "or" circuit 7 for outputting a judging signal suggesting that the motor is not in the rotating state when the upper or lower limit is exceeded, or the compressor interior is filled with liquid refrigerant.

The above control circuit 8, in ordinary drive controlling, according to the above exciting pattern mode based on the commutation signal detected by the rotation detecting means 1, outputs in order a drive signal to a pair of transistors of the drive circuit 10 to effect rotation control of the motor 25. On the other hand, when a judgment signal indicating that the compressor interior is filled with a liquid refrigerant is inputted from the judging means 2 when the motor 25 is activated, the motor 25 is step-driven. In this case, with the step driving, commutation to the exciting coils U, V an.-d W is effected through the drive circuit 10 so as to rotate the rotor 29 at a speed of no more than revolution one per second or one to two revolutions in several seconds. More specifically, commutation is effected while holding conduction to the exciting coils U, V and W for a short time for each exciting pattern, and actually control is effected to move the rotor 29 stepwise in the peripheral direction one step for each exciting pattern. The step drive of the motor has the step number obtained by dividing 360 degrees by integral multiplies of the number of phases of the applicable motor as described above.

Figure 6:
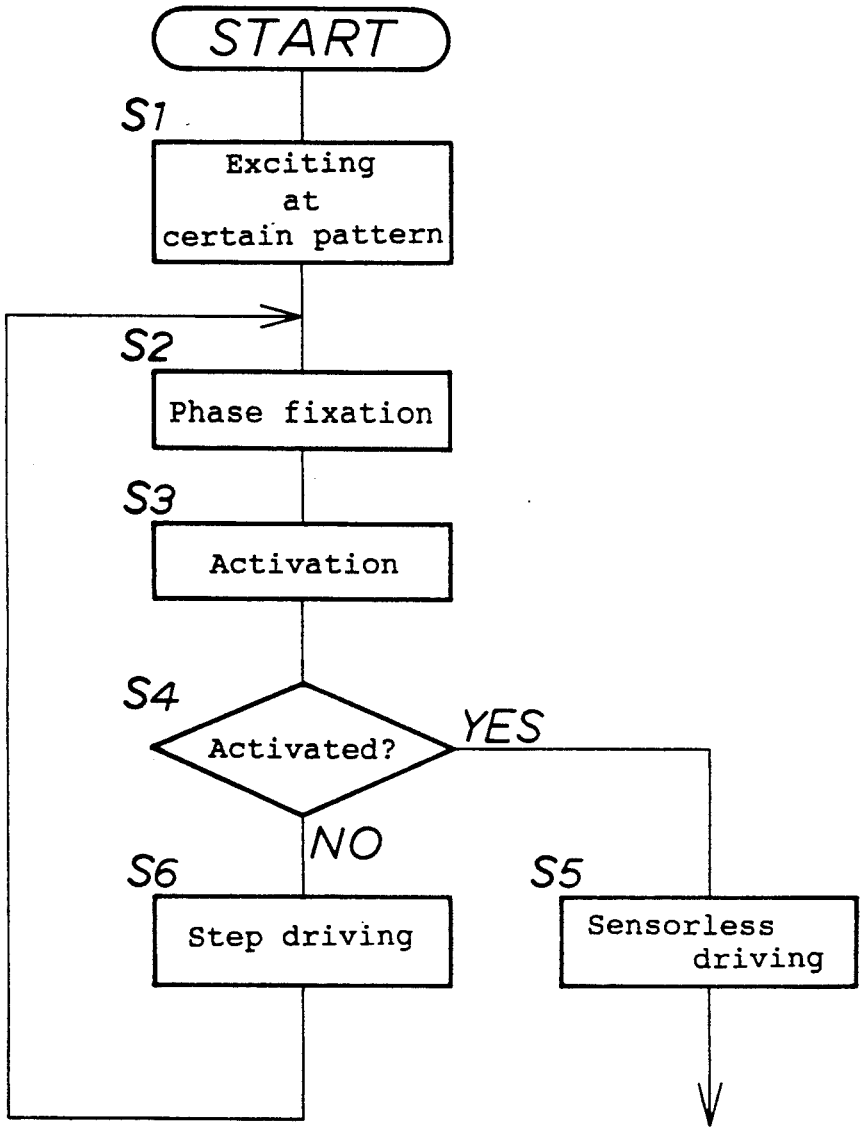
FIG. 6 is a flowchart of activation control.

Activation control of the compressor 20 by the above structured control means 60 will be described with reference to the flowchart of FIG. 6.

First, in step S1, the exciting coil is excited at a certain exciting pattern. For example, among the modes shown in FIG. 5, to make the exciting pattern of mode 5, chopper control is made by applying signals to a pair of transistors of drive circuit 10 from the control means 8; in step S2, that conduction state is held for a certain period (0.8 second); and the rotor 29 rotates to determine the position of the rotor. From this state to step S3, commutation is effected to switch a current to another exciting coil. In this case, exciting is effected in the exciting pattern of mode 3 advanced by two from mode 5.

Figure 7:
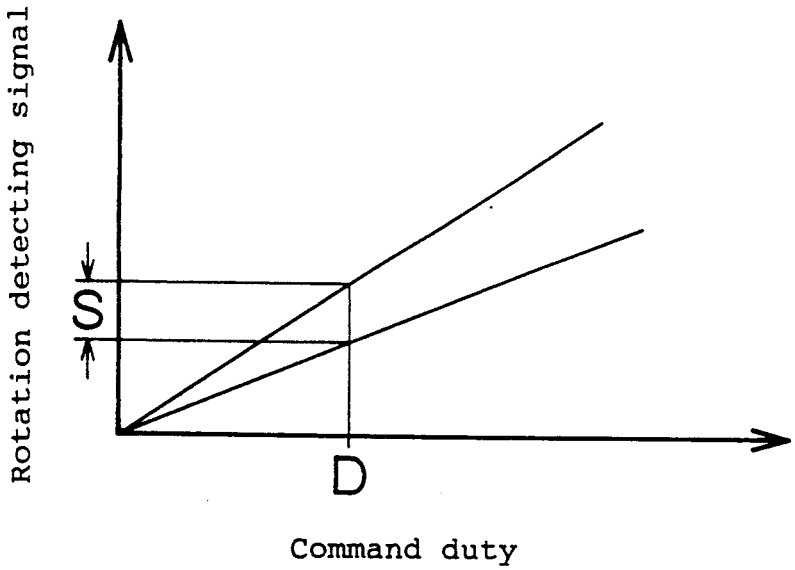
FIG. 7 is a drawing showing a judging range by command duty and detecting a rotation number.

In step S4, by the judging means 2, based on the command duty of the driving signal outputted to, the drive circuit 10 from the control means 8 and the detected rotation signal from the rotation detecting means 1, it is judged whether the motor 25 is activated or not. If activated, it is judged that the compressor 20 is not filled with liquid refrigerant and step S5 effects ordinary motor control, or position sensorless operation. On the other hand, when the motor 25 is not activated in the judging means 2, the compressor 20 is judged to be filled with the liquid refrigerated and the liquid refrigerant presents resistance against rotation of the rotor 29, and step S6 makes step driving of the motor 25 by the control means 8. And, in this embodiment, the judging means 2 judges that a certain rotation detecting signal S is detected by the rotation detecting means 1 with respect to the command duty D within a certain range of the drive signal outputted from the control means as shown in FIG. 7. This is, when the motor 25 is activated by applying the drive signal of a certain range of duty, if the compressor 20 is not filled with the liquid refrigerant, a certain rotation detecting signal is detected by the rotation detecting means 1, but if the compressor 20 is filled with the liquid refrigerant, by oscillation of the rotor 29, a rotation detecting signal of a certain value or more is detected or rotation signal is not obtained at all. Therefore, with a certain command duty D, when the rotation detecting signal takes a value other than the above S, sleep activation mode (step activation mode) is taken.

And the step driving in step S6 effects commutation in the next mode, for example excitation pattern of mode 2 shown in FIG. 5, and step 2 is resumed and phase fixing is effected, and steps S2 to S6 are repeated until activation is made. Therefore, in the procedure of mode of the predetermined excitation pattern, excitation is effected, and accordingly, the rotor 29 moves stepwise in the peripheral direction in order with each exciting pattern. As a result, rotation is very slow such as no more than once a second or once or twice in several seconds. And, with the rotation of the rotor 29, the rocking scroll member 33 of the compressor 20 rocks and, the liquid refrigerant within each compressing chamber 37, 38 and 39 is compressed, and the liquid refrigerant is succeedingly discharged. As a result, the compressor itself works as a pump and the liquid refrigerant in the case is surely excluded. Therefore, a conventionally used accumulator becomes needless, and the number of parts and assembling work do not increase.

The method to judge if the interior is filled with the liquid refrigerant is not limited to the above method. It is also possible to judge such a condition based on a rotation detecting signal application time (N-t) curve. Alternatively judgment whether the interior is filled with the liquid refrigerant may be made by constantly monitoring the pulse-to-pulse interval or the phase order of counter electromotive force generation.

As described above, the control unit of this invention controls the activation of the compressor which is filled with the liquid refrigerant by step driving, so that the compressor works as a pump to discharge the liquid refrigerant. As a result, no accumulator for sleep activation is necessary and the production cost can be reduced. Since the start is made slowly, the level of oscillation is lowered even after a long period of rest, and the seizure due to the lowering of oil does not occur when the start is made slowly. Further, since the activation is possible with the compressor filled with the liquid refrigerant, a heater or the like is not required.

What is claimed is:

1. A control unit for activating a compressor having a compressing part for compressing a refrigerant, a motor for driving the compressing part, and a drive circuit for driving the motor, comprising:

a rotation detecting means for detecting whether or not the motor is normally activated when the compressor is activated, a judging means for judging that the compressor interior is filled with a liquid refrigerant when the motor is not judged to be in a normal activating condition by the rotation detecting means, and a control means for step-driving the motor at a speed of no more than one rotation per second through the driving circuit when the compressor interior is judged to have been filled with the liquid refrigerant by the judging means.

2. A control unit for activating a compressor according to claim 1, wherein said motor is driven at a speed of approximately $\frac{2}{3}$ to 1/5 rotation per second.

3. A control unit for activating a compressor according to claim 1, wherein said compressor discharges the liquid refrigerant gradually.

4. A control unit for activating a compressor according to claim 1, wherein said compressor is a scroll type compressor.

5. A control unit for activating a compressor according to claim 1, wherein said motor consists of a driving shaft, a rotor, a stator and an exciting coil.

6. A control unit for activating a compressor according to claim 1, wherein said motor is a position sensorless, brushless DC motor.

7. A control unit for activating a compressor according to claim 1, wherein said drive circuit is connected with said rotation detecting means and said control means this order.

8. A control unit for activating a compressor according to claim 1, wherein said judging means comprises:

an F/V converter connected to said rotation detecting means for performing F/V conversion of a rotation signal, an integrating circuit connected to said control means for integrating a command duty signal, a comparator connected to said F/V converter and integrating circuit for determining whether outputs of said F/V converter and integrating circuit are higher or lower a predetermined upper or lower limit, and an "or" circuit connected to said comparator for outputting, when said upper or lower limit is exceeded, a judging signal indicating that said motor is not in a rotating state and said compressor is filled with said liquid refrigerant.

* * * * *